US009400448B2

(12) United States Patent
Imanishi et al.

(10) Patent No.: US 9,400,448 B2
(45) Date of Patent: Jul. 26, 2016

(54) IMAGE FORMING APPARATUS WITH A SURFACE OF A DEVELOPMENT ROLLER AND SHELL LAYERS OF TONER PARTICLES BEING FORMED FROM A THERMOSETTING RESIN

(71) Applicant: KYOCERA Document Solutions Inc., Osaka (JP)

(72) Inventors: Yasushi Imanishi, Osaka (JP); Kenshi Matsui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/512,618

(22) Filed: Oct. 13, 2014

(65) Prior Publication Data

US 2015/0104225 A1 Apr. 16, 2015

(30) Foreign Application Priority Data

Oct. 16, 2013 (JP) ..... 2013-215471

(51) Int. Cl.

| | |
|---|---|
| ***G03G 9/08*** | (2006.01) |
| ***G03G 9/097*** | (2006.01) |
| ***G03G 9/10*** | (2006.01) |

(Continued)

(52) U.S. Cl.

CPC ..... *G03G 15/0818* (2013.01); *G03G 9/0819* (2013.01); *G03G 9/0821* (2013.01); *G03G 9/0975* (2013.01); *G03G 9/09741* (2013.01); *G03G 9/09775* (2013.01); *G03G 9/10* (2013.01); *G03G 9/113* (2013.01); *G03G 9/1131* (2013.01); *G03G 9/1132* (2013.01); *G03G 9/1135* (2013.01); *G03G 9/1138* (2013.01); *G03G 9/1139* (2013.01)

(58) Field of Classification Search

CPC ..... G03G 9/0819; G03G 9/0821; G03G 9/09741; G03G 9/0975; G03G 9/09775; G03G 9/10; G03G 9/113; G03G 9/1131; G03G 9/1132; G03G 9/1135; G03G 9/1138; G03G 9/1139; G03G 15/0818

See application file for complete search history.

(56) References Cited

U.S. PATENT DOCUMENTS

| | | | | |
|---|---|---|---|---|
| 5,300,388 | A | 4/1994 | Inaba et al. | |
| 8,295,745 | B2 | 10/2012 | Matsuda et al. | |
| 2005/0271964 | A1 * | 12/2005 | Etou ..... | G03G 9/0806 430/110.2 |

(Continued)

FOREIGN PATENT DOCUMENTS

| | | | |
|---|---|---|---|
| JP | 03-220562 | A | 9/1991 |
| JP | 2000-330371 | A | 11/2000 |

(Continued)

OTHER PUBLICATIONS

An Office Action issued by the Japanese Patent Office on Feb. 2, 2016, which corresponds to Japanese Patent Application No. 2013-215471 and is related to U.S. Appl. No. 14/512,618.

*Primary Examiner* — Joseph S Wong

(74) *Attorney, Agent, or Firm* — Studebaker & Brackett PC

(57) ABSTRACT

An image forming apparatus uses a developer containing toner particles. The image forming apparatus includes a toner-particle bearing member for bearing the toner particles. Each toner particle includes a toner core containing a binder resin and a shell layer coating a surface of the toner core. The toner-particle bearing member includes a substrate and a surface layer coating a surface of the substrate. The surface layer and the shell layer are each formed from a resin containing a thermosetting resin.

10 Claims, 6 Drawing Sheets

(51) Int. Cl.
*G03G 9/113* (2006.01)
*G03G 15/08* (2006.01)

(56) References Cited

U.S. PATENT DOCUMENTS

| | | | | |
|---|---|---|---|---|
| 2012/0134721 | A1* | 5/2012 | Abe | G03G 15/0818 399/265 |
| 2013/0011779 | A1* | 1/2013 | Yamashita et al. | 430/109.4 |
| 2013/0022371 | A1* | 1/2013 | Kusahara et al. | 399/252 |
| 2013/0223891 | A1* | 8/2013 | Koyanagi et al. | 399/279 |

FOREIGN PATENT DOCUMENTS

| | | | |
|---|---|---|---|
| JP | 2004-333638 | A | 11/2004 |
| JP | 2005-115194 | A | 4/2005 |
| JP | 2005-274818 | A | 10/2005 |
| JP | 2007-148200 | A | 6/2007 |
| JP | 2009-108950 | A | 8/2009 |
| JP | 2009-180950 | A | 8/2009 |
| JP | 2011-154364 | A | 8/2011 |
| JP | 2011-237630 | A | 11/2011 |

* cited by examiner

IMAGE FORMING APPARATUS WITH A SURFACE OF A DEVELOPMENT ROLLER AND SHELL LAYERS OF TONER PARTICLES BEING FORMED FROM A THERMOSETTING RESIN

INCORPORATION BY REFERENCE

The present application claims priority under 35 U.S.C. §119 to Japanese Patent Application No. 2013-215471, filed Oct. 16, 2013. The contents of this application are incorporated herein by reference in their entirety.

BACKGROUND

The present disclosure relates to an image forming apparatus provided with a toner-particle bearing member and also relates to an image forming method performed by the image forming apparatus.

In the technical field of image formation employing electrophotography, toner particles of a core-shell structure in which each toner particle includes a toner core and a shell layer coating the toner core are known. In addition, an image forming apparatus having a toner-particle bearing member that includes a substrate and a resin layer formed on the surface of the substrate is known.

SUMMARY

An image forming apparatus according to the present disclosure uses a developer containing toner particles. The image forming apparatus includes a toner-particle bearing member configured to bear the toner particles. Each toner particle includes: a toner core containing a binder resin; and a shell layer coating a surface of the toner core. The toner-particle bearing member includes a substrate and a surface layer coating a surface of the substrate. The surface layer and the shell layers are each formed from a resin containing a thermosetting resin.

An image forming method according to the present disclosure involves forming, by an image forming apparatus, an image with use of a developer. The developer includes toner particles each of which includes: a toner core containing a binder resin; and a shell layer coating a surface of the toner core. The image forming apparatus includes a toner-particle bearing member configured to bear the toner particles. The toner-particle bearing member includes: a substrate; and a surface layer coating a surface of the substrate. The surface layer and the shell layers are each formed from a resin containing a thermosetting resin.

DETAILED DESCRIPTION

The following describes an embodiment of the present disclosure in detail. The present disclosure is in no way limited to the specific embodiment described below, and various alterations may be appropriately made within the scope of the objects of the present disclosure. Note that some overlapping explanations may be appropriately omitted, but such omission is not intended to limit the gist of the disclosure.

The image forming apparatus according to the present embodiment uses a developer containing toner particles and includes a toner-particle bearing member (for example, a development roller) for bearing the toner particles. Each toner particle includes: a toner core containing a binder resin; and a shell layer coating a surface of the toner core. The toner-particle bearing member includes a substrate and a surface layer coating a surface of the substrate. The surface layer and the shell layers are each formed from a resin containing a thermosetting resin.

The following describes in detail the toner particles, the developer, the toner-particle bearing member, and the image forming apparatus.

(Toner Particles)

Figure 1:
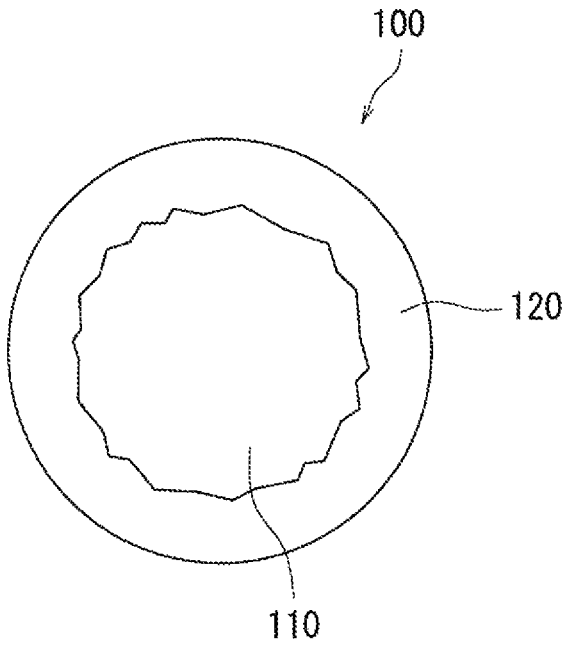
FIG. 1 is a schematic view showing a toner particle borne by a toner-particle bearing member included in an image forming apparatus according to an embodiment.

With reference to FIG. 1, the toner particles are described in detail. FIG. 1 shows one of toner particles 100. The toner particle 100 includes a toner core 110 and a shell layer 120. The toner core 110 contains a binder resin. The shell layer 120 is formed from a resin containing a thermosetting resin and coats a surface of the toner core 110. In the toner particle 100, the toner core 110 is anionic, whereas the shell layer 120 is cationic.

The following describes the components of the toner core 110. The binder resin is an essential component of the toner core 110. The binder resin is anionic, and specific examples of the binder resin include a resin having a functional group such as an ester group, a hydroxyl group, a carboxyl group, an amino group, an ether group, an acid group, or a methyl group. The binder resin preferably has a functional group such as a hydroxyl group, a carboxyl group, or an amino group in a molecular, and more preferably has a hydroxyl group and/or a carboxyl group in a molecular. These functional groups are preferred because they react with the thermosetting component (for example, methylol melamine) contained in the resin forming the shell layer to be chemically bonded thereto. Consequently, the toner particle 100 formed from a binder resin having such a functional group has a strong bond between the shell layer 120 and the toner core 110.

For the binder resin containing a carboxyl group to be sufficiently anionic, the acid value of the binder resin is preferably 3 mgKOH/g or more and 50 mgKOH/g or less, and more preferably 10 mgKOH/g or more and 40 mgKOH/g or less.

For the binder resin containing a hydroxyl group to be sufficiently anionic, the hydroxyl value of the binder resin is preferably 10 mgKOH/g or more and 70 mgKOH/g or less, and more preferably 15 mgKOH/g or more and 50 mgKOH/g or less.

Specific examples of the binder resin include thermoplastic resins (for example, styrene resins, acrylic resins, styrene-acrylic resins, polyethylene resins, polypropylene resins, vinyl chloride resins, polyester resins, polyamide resins, polyurethane resins, polyvinyl alcohol resins, vinyl ether resins, N vinyl resins, and styrene-butadiene resins). As the binder resin, styrene-acrylic resins and/or polyester resins are preferred for improving the dispersibility of the colorant in the toner cores, charging characteristics of the toner particles, and fixability of the toner particles to a recording medium.

A styrene acrylic resin is a copolymer of a styrene-based monomer and an acrylic-based monomer. Specific examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Specific examples of the acrylic-based monomer include: (meth)acrylic acid; (meth)acrylic acid alkyl ester (such as methyl(meth)acrylate, ethyl(meth)acrylate, n-propyl(meth) acrylate, iso-propyl(meth)acrylate, n-butyl(meth)acrylate, iso-butyl(meth)acrylate, and 2-ethylhexyl(meth)acrylate); and (meth)acrylic acid hydroxyalkyl ester (such as 2-hydroxyethyl(meth)acrylate, 3-hydroxypropyl(meth)acrylate, 2-hydroxypropyl(meth)acrylate, and 4-hydroxypropyl (meth)acrylate). Note that (meth)acrylic acid is used as a generic term referring to both acrylic acid and methacrylic acid.

In preparation of the styrene acrylic resin, a hydroxyl group can be introduced into the styrene acrylic resin by using a monomer having a hydroxyl group (such as p-hydroxystyrene, m-hydroxystyrene, or (meth)acrylic acid hydroxyalkyl ester). By appropriately adjusting the amount of the monomer having a hydroxyl group, the hydroxyl value of the resultant styrene acrylic resin can be adjusted.

In preparation of the styrene acrylic resin, a carboxyl group can be introduced into the styrene acrylic resin by using a (meth)acrylic acid as the monomer. By appropriately adjusting the amount of the (meth)acrylic acid, the acid value of the styrene acrylic resin can be adjusted.

The polyester resin is obtained through condensation polymerization or co-condensation polymerization of a dihydric or trihydric or higher-hydric alcohol component and a dibasic or tribasic or higher-basic carboxylic acid component.

Specific examples of dihydric alcohol components include diols (such as ethylene glycol, diethylene glycol, triethylene glycol, 1,2-propanediol, 1,3-propanediol, 1,4-butanediol, neopentyl glycol, 1,4-butanediol, 1,5-pentanediol, 1,6-hexanediol, 1,4-cyclohexanedimethanol, dipropylene glycol, polyethylene glycol, polypropylene glycol, and polytetramethylene glycol), bisphenols (such as bisphenol A, hydrogenated bisphenol A, polyoxyethylenated bisphenol A, and polyoxypropylenated bisphenol A).

Specific examples of tri- or higher-hydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of dibasic carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid. Other examples of dibasic carboxylic acid components include alkyl (or alkenyl) succinic acid (for example, n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid).

Specific examples of tri- or higher-carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid. These dicarboxylic or tri- or higher-carboxylic acid components may be used in a derivative form having ester formation properties such as an acid halide, an acid anhydride, or a lower alkyl ester. The term "lower alkyl" used herein refers to an alkyl group having 1 to 6 carbon atoms.

The acid value and the hydroxyl value of the polyester resin can be adjusted by appropriately changing the amount of a dihydric or trihydric or higher-hydric alcohol component and a dibasic or tribasic or higher-basic carboxylic acid component used to produce the polyester resin. The acid value and the hydroxyl value of the polyester resin tend to decrease in response to an increase in the molecular weight of the polyester resin.

When the binder resin is a polyester resin, the number average molecular weight (Mn) of the polyester resin is preferably 1,200 or more and 2,000 or less for improving strength and fixability of the toner cores 110. For the same reason, the molecular weight distribution of the polyester resin (Mw/Mn, which is the ratio of the mass average molecular weight Mw to the number average molecular weight Mn) is preferably 9 or more and 20 or less.

When the binder resin is a styrene acrylic resin, the number average molecular weight Mn of the styrene acrylic resin is preferably 2,000 or more and 3,000 or less for improving the strength and fixability of the toner cores 110. For the same reason, the molecular weight distribution of the styrene acrylic resin is preferably 10 or more and 20 or less. The number average molecular weight (Mn) and the mass average molecular weight (Mw) of the binder resin can be measured by gel permeation chromatography.

For improving the fixability of the toner particles 100, the glass transition point Tg of the binder resin is preferably equal to or less than the curing start temperature of the thermosetting resin contained in the shell layers 120. With the binder resin having the glass transition point Tg equal to or less than the curing start temperature, the resulting toner particles 100 have sufficient fixability at high-speed fixing. The glass transition point Tg of the binder resin is preferably 20° C. or more, and more preferably 30° C. or more and 55° C. or less, and particularly preferably 30° C. or more and 50° C. or less. With the binder resin having the glass transition point Tg of 20° C. or more, aggregation of the toner cores 110 at the time of forming the shell layers 120 is restricted. Typically, the curing start temperature of the thermosetting resin approximately 55° C.

The glass transition point Tg of the binder resin can be determined from an inflection point of specific heat measured on the binder resin using a differential scanning calorimeter (DSC). For example, the glass transition point Tg of the binder resin can be determined by obtaining the heat absorption curve of the binder resin with the use of a differential scanning calorimeter (for example, "DSC-6200" manufactured by Seiko Instruments Inc.) as a measuring device. More specifically, a 10 mg of the measurement sample is placed in an aluminum pan, and an empty aluminum pan is used as a reference. Then, the heat absorption curve of the binder resin is obtained under the conditions of the measurement temperature of 25° C. or more and 200° C. or less and the heating rate of 10° C./minute. Then, the glass transition point Tg of the binder resin is determined based on the thus obtained heat absorption curve.

The softening point Tm of the binder resin is preferably 100° C. or less and more preferably 95° C. or less. With the binder resin having a softening point Tm of 100° C. or less, the sufficient fixability of the toner is ensured even during high-speed fixing. The softening point Tm of the binder resin is adjusted by, for example, combining different binder resins having different softening points Tm.

The softening point Tm of the binder resin can be measured by using a capillary rheometer (for example, "CFT-500D" manufactured by Shimadzu Corporation). More specifically, the measurement sample is set in the capillary rheometer to cause 1 $cm^3$ of the sample to melt flown under the predetermined conditions (the dies diameter of 1 mm, a plunger load of 20 $kg/cm^2$, and a heating rate of 6° C./minute). Based on the measurement results, an S-shaped curve (the S-shaped curve of the temperature (° C.)/the stroke (mm)) is obtained. Then, the softening point Tm of the binder resin is read from the S-shaped curve.

Figure 2:
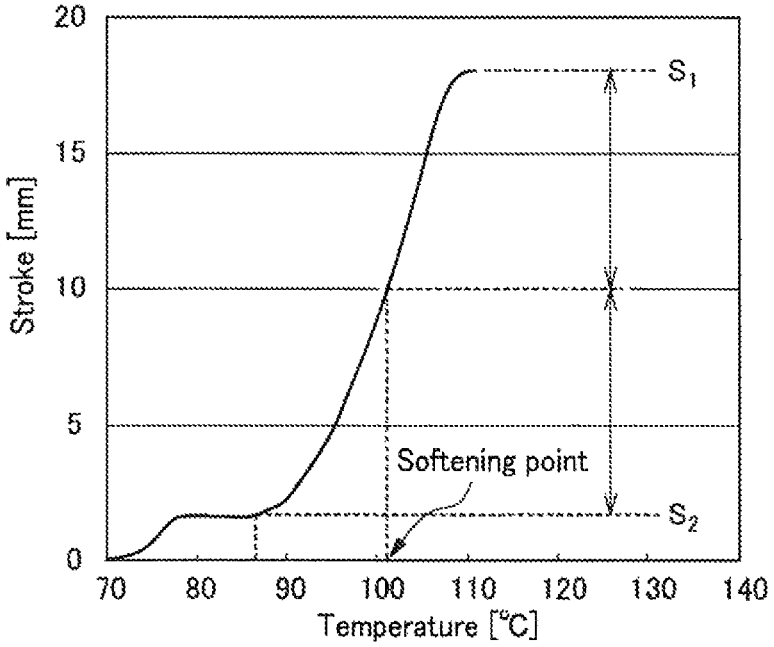
FIG. 2 is a view illustrating how to read the softening point Tm of a binder resin.

With reference to FIG. 2, the following explains a method for reading the softening point (Tm) of the binder resin. In FIG. 2, $S_1$ is a maximum stroke value and $S_2$ is a base-line stroke value at a lower temperature than $S_1$. The softening point (Tm) of the measurement sample (binder resin) is read as a temperature on the S-shaped curve corresponding to a stroke value of $(S_1+S_2)/2$.

With further reference to FIG. 1, the following describes the toner particles 100. The toner cores 110 may contain a known pigment or dye as a colorant in accordance with the color of the toner particles 100. Carbon black is an example of a black colorant. In another example, a colorant which is adjusted to a black color using colorants described below, such as a yellow colorant, a magenta colorant, and a cyan colorant, can be used as the black colorant.

When the toner particles 100 are of a color toner, the colorant contained in the toner cores 110 can for example be a yellow colorant, a magenta colorant, or a cyan colorant.

The toner cores 110 may contain a releasing agent for the purpose of improving the fixability of the toner to restrict occurrence of offset or image smearing (smudges of an image occurred when the image is rubbed). Examples of releasing agents include aliphatic hydrocarbon waxes (such as low molecular weight polyethylene, low molecular weight polypropylene, polyolefin copolymers, polyolefin waxes, microcrystalline waxes, paraffin waxes, and Fischer-Tropsch waxes), oxides of aliphatic hydrocarbon waxes (such as oxidized polyethylene waxes, and block copolymers of oxidized polyethylene waxes), plant waxes (such as candelilla wax, carnauba wax, Japan wax, jojoba wax, and rice wax), animal waxes (such as beeswax, lanolin, and spermaceti), mineral waxes (such as ozokerite, ceresin, and petrolatum), waxes containing a fatty acid ester as a major component (such as montanic acid ester wax, and castor wax), and waxes containing partially or fully deoxidized fatty acid esters (such as deoxidized carnauba wax).

The content of the releasing agent is preferably 1 part by mass or more and 30 parts by mass or less with respect to 100 parts by mass of the binder resin, and more preferably 5 parts by mass or more and 20 parts by mass or less for improving fixability, offset resistance, and image smearing resistance of the toner particles 100.

The toner cores 110 may contain a charge control agent as necessary. The charge control agent is used for improving the charge level or charge rising property thereby to obtain toner particles 100 having excellent durability and stability. The charge rising property serves as an index indicating whether the toner can be charged to a predetermined charge level within a short period of time. Since the toner cores 110 are anionic (negatively chargeable), a negatively-chargeable charge control agent is used.

The toner cores 110 may contain magnetic powder as necessary. When the toner cores 110 contain magnetic powder, a developer containing the toner particles 100 is used as a magnetic one-component developer. Preferred examples of the magnetic powder include iron (for example, ferrite and magnetite), ferromagnetic metals (for example, cobalt and nickel), alloys containing either or both of iron and ferromagnetic metal, compounds containing either or both of iron and ferromagnetic metal, ferromagnetic alloys subjected to ferromagnetization, such as a thermal treatment, and chromium dioxide.

The particle size of the magnetic powder is preferably 0.1 μm or more and 1.0 μm or less, and more preferably 0.1 μm or more and 0.5 μm or less. With the particle size of 0.1 μm or more and 1.0 μm or less, the magnetic powder can be readily dispersed uniformly in the binder resin.

For the toner particles 100 used as a magnetic one-component developer, the content of the magnetic power is preferably 35 parts by mass or more and 60 parts by mass or less with respect to 100 parts by mass of the toner particles 100, and more preferably 40 parts by mass or more and 60 parts by mass or less. For the toner particles 100 used as a two-component developer in combination with a carrier described later, the content of the magnetic powder is preferably 20 parts by mass or less with respect to 100 parts by mass of the toner particles 100, and more preferably 15 parts by mass or less.

In the present embodiment, an indication of the toner cores 110 being anionic is that the zeta-potential of the toner cores 110 measured in an aqueous medium adjusted to pH 4 is negative. For the toner cores 110 to be sufficiently anionic, the zeta-potential of the toner cores 110 is preferably −10 mV or less. Another indication of the toner cores 110 being anionic is that a triboelectric charge of the toner cores 110 with a standard carrier is −10 μC/g or less. The triboelectric charge indicates tendency of the toner cores to be charged and whether such charging tends to be positive or negative polarity.

The following describes the shell layers 120 in detail. First, the resin forming the shell layers 120 is described below. The resin forming the shell layers 120 contains a thermosetting resin to improve the strength and hardness of the shell layers 120 and to make the shell layers 120 to be sufficiently cationic. In the description and claims of the present disclosure, the thermosetting resin contains a unit obtained by introducing a methylene group (—$CH_2$—) derived from formaldehyde into a monomer of melamine, for example.

Examples of the thermosetting resin include melamine resins, guanamine resins, sulfonamide resins, urea resins, glyoxal resins, aniline resins, and polyimide resins. Preferably, the thermosetting resin is at least one resin selected from the group of amino resins consisting of a melamine resin, a urea resin, and a glyoxal resin.

The melamine resin is a polycondensate of melamine and formaldehyde. Thus, melamine is the monomer used to form the melamine resin. The urea resin is a polycondensate of urea and formaldehyde. Thus, urea is the monomer used to form the urea resin. The glyoxal resin is a polycondensate of formaldehyde and a reaction product of glyoxal and urea. Thus, the reaction product of glyoxal and urea is the monomer used to form the glyoxal resin. The melamine and urea may be denatured in a known manner.

The content of the thermosetting resin in the shell layers 120 is preferably 80% by mass or more, and more preferably 90% by mass or more, and most preferably 100% by mass, for restricting the electrostatic adsorption of the toner particles 100 to a toner-particle bearing member 400, for preventing the toner particles 100 from being embedded in the toner-particle bearing member 400, and for improving the strength of the shell layers 120.

Preferably, the shell layers 120 contain a nitrogen atom derived from melamine, urea, or the like. A material containing a nitrogen atom is readily charged positively, which assists the toner particles 100 to be positively charged to a desired charge level. In view of this, the content of the nitrogen atom in the shell layer 120 is preferably 10% by mass or more.

The shell layers 120 may contain a thermoplastic resin. Specific examples of the thermoplastic resin used for forming the shell layers 120 include acrylic resins, styrene-(meth) acrylic copolymer resins, silicone-(meth)acrylic graft copolymers, polyurethane resins, polyester resins, polyvinyl alcohol resins, and ethylene vinyl alcohol copolymers. When the resin forming the shell layers 120 contains a thermoplastic resin, the thermosetting resin contained in the shell layers 120 may contain a derivative methylolated with formaldehyde prior to the reaction with the thermoplastic resin.

The thickness of the shell layers 120 is preferably 20 nm or less, and more preferably 1 nm or more and 20 nm or less, and further more preferably 1 nm or more and 10 nm or less. With a thickness of 20 nm or less, the shell layers 120 are ensured to rupture easily upon, for example, heat and pressure applied to fix the toner particles 100 to a recording medium. As a result, the binder resin contained in the toner cores 110 softens or melts rapidly, so that the toner particles 100 can be fixed to a recording medium at low fixing temperatures. In addition, the shell layers 120 having such a thickness are not chargeable to an excessively high level, which ensures appropriate image formation. On the other hand, with a thickness of 1 nm or more, the shell layers 120 are ensured to have sufficient strength. Therefore, the shell layers 120 can be less prone to rupturing due to an impact occurring during transport, for example. In addition, the shell layers 120 having a thickness of 1 nm or more are ensured to be charged to a level that is not too low. Therefore, occurrence of image defects can be restricted.

The thickness of a shell layer 120 can be measured by analyzing a transmission electron microscopy (TEM) image of a cross-section of a toner particle 100 using commercially available image-analyzing software (for example, "WinROOF" manufactured by Mitani Corporation). More specifically, on the cross-section of a toner particle 100, two straight lines are drawn to intersect at right angles at approximately the center of the cross-section. Then, the lengths of four segments of the two lines crossing the shell layer 120 are measured. An average value of the measured lengths of the four segments is determined to be the thickness of the shell layer 120 of the toner particle 100 being measured. In the present specification, the thickness of the shell layer 120 is measured for at least ten toner particles 100, and an average value of the thus measured thicknesses of the respective shell layers 120 is determined to be the thickness of the shell layers 120.

With respect to a shell layer 120 that is excessively thin, the TEM image may not clearly depict a boundary between the shell layer 120 and the toner core 110, complicating measurement of thickness of the shell layer 120. The thickness of such a shell layer 120 can be measured by clarifying the boundary between the shell layer 120 and the toner core 110 in the TEM image through the use of TEM imaging combined with energy dispersive X-ray spectroscopic analysis (EDX). More specifically, the boundary is clarified in the TEM image by mapping of a characteristic element (for example, nitrogen) in a material of the shell layer 120 through EDX.

The shell layers 120 may contain a charge control agent. Since the shell layers 120 are cationic (positively chargeable), a positively-chargeable charge control agent may be contained.

The volume average diameter of the toner particles 100 are preferably 4.0 μm or more and 10.0 μm or less for improving the fixability and handleability of the toner. In addition, the number average diameter of the toner particles 100 are preferably 3.0 μm or more and 9.0 μm or less.

The toner particles 100 may each have a plurality of shell layers 120 stacked on the surface of the toner core 110. In such a case, it is sufficient that the outermost shell layer 120 of the toner core 110 be cationic.

The toner particles 100 may be treated with an external additive for improving the fluidity and handleability of the toner. The method of the external addition treatment is not specifically limited, and any known method can be used. Examples of the external additive include particles of silica and metal oxides (for example, alumina, titanium oxide, magnesium oxide, zinc oxide, strontium titanate, and barium titanate).

(Developer)

A developer used in the present embodiment contains the toner particles 100. The developer used in the present embodiment may be a one-component developer or a two-component developer.

Figure 3:
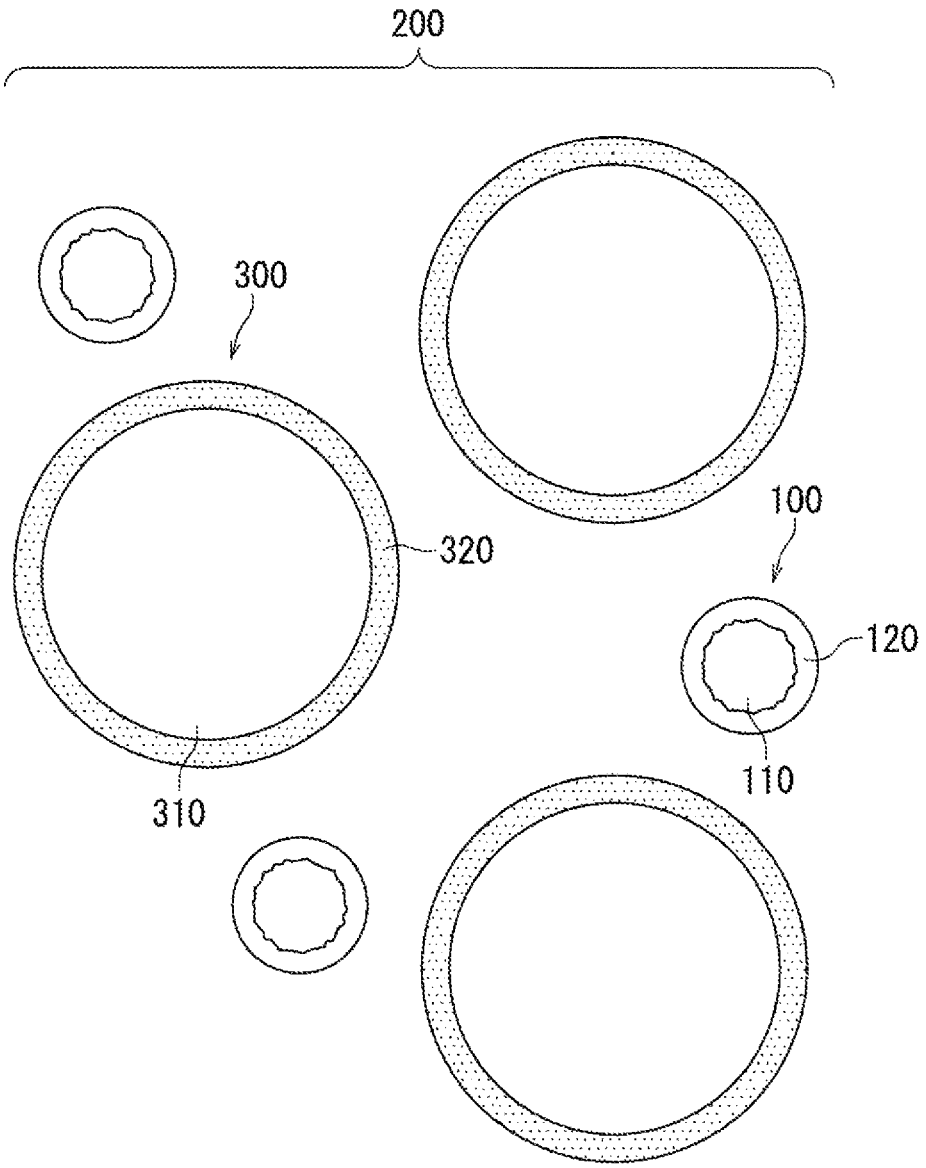
FIG. 3 is a schematic view showing a two-component developer used by the image forming apparatus according to the present embodiment.

With reference to FIG. 3, the following describes the details of where the developer used in the present embodiment is a two-component developer including the toner particles 100. FIG. 3 shows a two-component developer 200. The two-component developer 200 is a mixture of the toner particles 100 and a carrier 300.

Examples of the carrier 300 include a magnetic carrier. In one example, the carrier 300 includes carrier cores 310 each having a surface coated with a resin layer 320. Specific examples of the carrier cores 310 include: particles of iron, oxidized iron, reduced iron, magnetite, copper, silicon steel, ferrite, nickel, or cobalt; particles of alloys of one or more of these materials and a metal, such as manganese, zinc, or aluminum; particles of iron-nickel alloys or iron-cobalt alloys; particles of ceramics, such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; particles of high-dielectric substances, such as ammonium dihydrogen phosphate, potassium dihydrogen phosphate, or Rochelle salt. Alternatively, the carrier cores 310 may also be a resin carrier in which any of the above listed particles are dispersed in a resin, for example.

Examples of the resin contained in the resin layers 320 coating the surfaces of the carrier cores 310 include: (meth) acrylic-based polymers, styrene-based polymers, styrene-(meth)acrylic-based copolymers, olefin-based polymers (for example, polyethylene resins, chlorinated polyethylene resins, and polypropylene resins), polyvinyl chloride resins, polyvinyl acetate resins, polycarbonate resins, cellulose resins, polyester resins, unsaturated polyester resins, polyamide resins, polyurethane resins, epoxy resins, silicone resins, fluorine resins (for example, polytetrafluoroethylene, polychlorotrifluoroethylene, and polyvinylidene fluoride), phenolic resins, xylene resins, diallylphthalate resins, polyacetal resins, and amino resins. These resins may be used alone, or two or more of these resins may be used in combination.

The particle size of the carrier 300 is preferably 20 μm or more and 120 μm or less, and more preferably 25 μm or more and 80 μm or less. The particle size of the carrier 300 can be measured by using an electron microscope.

In the case where the developer used in the present embodiment is the two-component developer 200, the content of the toner particles 100 in the two-component developer 200 is preferably 3% by mass or more and 20% by mass or less, and more preferably 5% by mass or more and 15% by mass or less with respect to the mass of the two-component developer 200.

(Toner-Particle Bearing Member)

Figure 4:
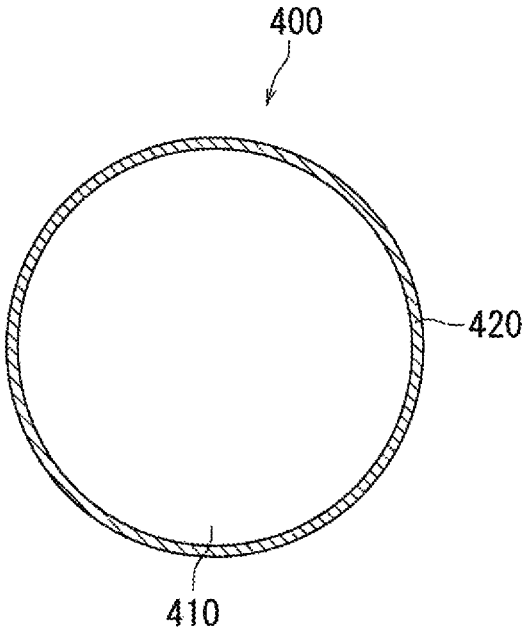
FIG. 4 is a schematic view showing the toner-particle bearing member included in the image forming apparatus according to the present embodiment.

With reference to FIG. 4, the following describes the image forming apparatus according to the present embodiment. FIG. 4 shows the toner-particle bearing member 400 included in the image forming apparatus according to the present embodiment. The toner-particle bearing member 400 includes a substrate 410 and a surface layer 420 coating a surface of the substrate 410.

Examples of the material for the substrate 410 include non-magnetic metal (for example, aluminum, stainless steel, and brass) and alloys of such non-magnetic metals. For example, the substrate 410 may have the shape of a solid cylinder, a hollow cylinder, or a belt.

The toner-particle bearing member 400 may be internally provided with a magnetic roller or the like having a magnet disposed therein so that the toner particles 100 are magnetically attracted to and retained on the surface layer 420 of the toner-particle bearing member 400.

The following describes the details of the surface layer 420. The surface layer 420 is formed from a resin containing a thermosetting resin. Examples of the thermosetting resin include melamine resins, guanamine resins, sulfonamide resins, urea resins, glyoxal resins, aniline resins, and polyimide resins. The thermosetting resin is preferably at least one resin selected from the group of amino resins consisting of a melamine resin, a urea resin, and a glyoxal resin, and the most preferable is a melamine resin.

That is, in the image forming apparatus according to the present embodiment, the surface layer 420 of the toner-particle bearing member 400 as well as the shell layers 120 of the toner particles 100 is formed from a resin containing a thermosetting resin. This can restrict the toner particles 100 from electrostatically adhering to the surface layer 420 or being embedded in the surface layer 420. This can also improve the strength of the surface layer 420 and the shell layers 120 as well as the durability of the toner-particle bearing member 400 and the toner particles 100.

The content of the thermosetting resin in the surface layer 420 is preferably 80% or more, more preferably 90% by mass or more, and most preferably 100% by mass. This is for restricting the toner particles 100 from electrostatically adhering to or being embedded in the surface layer 420 and also for improving the strength of the surface layer 420.

Preferably, the resin forming the surface layer 420 and the resin forming the shell layers 120 contain the same thermosetting resin. This is effective to reduce the difference between the work function of the surface layer 420 and the work function of the shell layers 120. Consequently, the toner particles 100 are effectively restricted from electrostatically adhering to or being embedded in the surface layer 420. As a result, the image forming apparatus is ensured to have high durability and enabled to stably charge the toner particles 100. This image forming apparatus can ensure high-quality images. The difference between the work function of the surface layer 420 and the work function of the shell layers 120 is preferably 0.5 eV or less, more preferably 0.2 eV or less, and most preferably 0 eV.

The work function of the surface layer 420 and the work function of the shell layers 120 are both preferably 3.0 eV or more. With the surface layer 420 and the shell layers 120 both having the work function of 3.0 eV or more, the surface of the toner-particle bearing member 400 is ensured to have excellent chargeability. Consequently, the toner particles 100 are restricted from electrostatically adhering to or being embedded in the surface layer 420. In addition, the charge level of the toner particles 100 is restricted from being excessively high.

The respective work functions of the surface layer 420 and the shell layers 120 can be determined by using a photoemission spectroscopy ("AC-1" manufactured by Riken Keiki Co., Ltd.), for example.

For controlling the work function, the surface layer 420 and the shell layers 120 may contain a work-function controlling agent. The work-function controlling agent is not particularly limited as long as the work function is controlled to fall within an appropriate range, and an organic compound is one example. An appropriate content of the work-function controlling agent in the surface layer 420 or the shell layers 120 depends on the type of the work-function controlling agent contained. By appropriately adjusting the content of the work-function controlling agent, a desired work function can be achieved.

Also, the work function may be controlled by appropriately adjusting the thicknesses of the surface layer 420 and the shell layers 120 to fall within appropriate ranges. The thickness of the surface layer 420 is preferably 5 nm or more and 100 nm or less, and more preferably 5 nm or more and 20 nm or less. The surface layer 420 having a thickness of 5 nm or more can improve the durability of the toner-particle bearing member 400. With the thickness of 100 nm or less, the surface layer 420 can be ensured to be uniform in thickness. The thickness of the shell layers 120 is preferably 5 nm or more and 100 nm or less, and more preferably 50 nm or more and 100 nm or less. The shell layers 120 having a thickness of 5 nm or more can improve the durability of the toner particles 100. With a thickness of 100 nm or less, the shell layers 120 can be ensured to be uniform in thickness. In addition, the shell layers 120 having such a thickness can rupture easily, which ensures excellent fixability of the toner particles 100.

For adjustment of the chargeability of the toner-particle bearing member 400, the surface layer 420 may additionally contain a charge control agent.

The method employed for forming the surface layer 420 on the surface of the substrate 410 may involve: obtaining a dispersion by dispersing and mixing materials of the surface layer 420 in a solvent; applying the resulting dispersion to the surface of the substrate 410; and drying to solidify the applied dispersion or hardening the applied dispersion. The materials are dispersed and mixed in the solvent by using, for example, a known disperser, such as a sand mill, a paint shaker, DYNO-MILL, or Pearl Mill. Examples of the disperser include "Starmill" manufactured by Ashizawa Finetech Ltd., "CAVITRON" manufactured by Eurotec, Ltd., and "Filmix" manufactured by PRIMIX Corporation.

The method for applying an application liquid to the substrate 410 include dip coating, spray coating, and roll coating.

(Image Forming Apparatus)

The following describes the image forming apparatus according to the present embodiment. The image forming apparatus according to the present embodiment includes the toner-particle bearing member 400 and uses the toner particles 100. The image forming apparatus according to the present embodiment employs touchdown developing, for example. In the touchdown developing, a two-component developer is used to form images. Typically, an image forming apparatus employing touchdown developing requires the residual toner particles 100 (toner particles remaining on the toner-particle bearing member 400 after image formation) to be once removed from the surface of the toner-particle bearing member 400 for the following reason. That is, the toner particles 100 remaining on the surface of the tone-particle bearing member 400 excessively raise the charge level of the toner particles 100 subsequently supplied for developing, which reduces the developability of the toner. This may result in forming images with a density lower than desired.

Note that a thermosetting resin has high positive chargeability. Therefore, when an image forming apparatus employing touchdown developing uses the toner particles 100 each having a shell layer 120 formed from a resin containing the thermosetting resin, the toner particles 100 residing on the surface of the toner-particle bearing member 400 are notably charged to an excessively high level. To restrict the toner particles 100 from being charged to an excessively high level, it is effective to form the surface of the toner-particle bearing member 400 with a material chargeable to the same polarity as the charging polarity of the shell layers 120. Yet, the hardness of the thermosetting resin contained in the shell layers 120 is high. Thus, forming the surface layer 420 of the toner-particle bearing member 400 from a low-hardness resin (a resin other than the thermosetting resin) would result in the shell layers 120 rupturing the surface layer 420. In addition, if the shell layers 120 and the surface layer 420 are formed from the same material other than the thermosetting resin, the shell layers 120 have strong affinity for the surface layer 420 and vice versa, which causes the toner particles 100 to readily adhere to the toner-particle bearing member 400. This makes it difficult to maintain the development stability of the image forming apparatus. In contrast, in the image forming apparatus according to the present embodiment, the shell layers 120 and the surface layer 420 are formed from a resin containing the same thermosetting resin. This configuration can restrict the toner particles 100 from being charged to an excessively high level and consequently restrict the toner particles 100 from being embedded in or adhering to the surface of the toner-particle bearing member 400. In addition, the durability of the toner-particle bearing member 400 and the toner particles 100 can be improved.

In the image formation employing two-component developing or one-component developing, the toner particles 100 apply stress to the surface of the toner-particle bearing member 400 when the two-component developer 200 or the toner particles 100 (one-component developer) is pressed thereagainst by a regulating blade, for example. In contrast, the touchdown developing exploits the action of the electric field to retain the toner particles 100 on the surface of the toner-particle bearing member 400, which means that the stress applied by the toner particles 100 to the toner-particle bearing member 400 is small. In addition, the shell layers 120 of the toner particles 100 as well as in the surface layer 420 of the toner-particle bearing member 400 both contain a thermosetting resin, which has high hardness. Therefore, the affinity that the surface layer 420 and the shell layers 120 have for one another is restricted even under the stress applied by the toner particles 100. Furthermore, the shell layers 120 of the toner particles 100 as well as the surface layer 420 of the toner-particle bearing member 400 each contain a thermosetting resin having, in addition to high hardness, a work function of a similar value. Therefore, the toner particle 100 are restricted from being charged to an excessively high level and from electrostatically adhering to or being embedded in the surface of the toner-particle bearing member 400.

Figure 5:
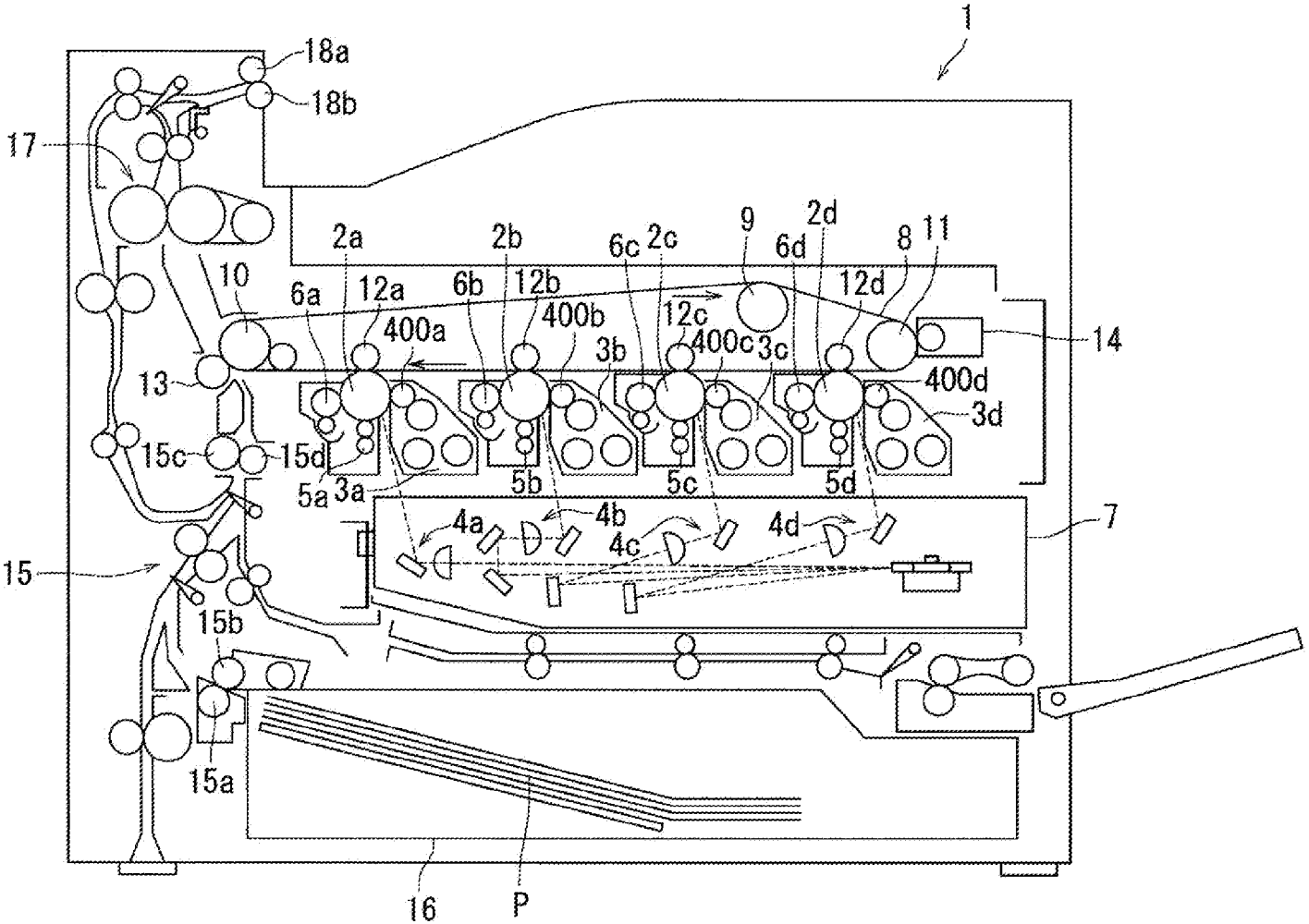
FIG. 5 is a schematic view showing one example of the overall structure of the image forming apparatus according to the present embodiment.

With reference to FIG. 5, the following describes the overall structure of the image forming apparatus according to the present embodiment. FIG. 5 is a schematic view of showing the overall structure of the image forming apparatus 1 according to the present embodiment. The image forming apparatus 1 is provided with toner-particle bearing members 400*a* to 400*d*, which are collectively described above as the toner-particle bearing member 400, and rotatable photosensitive members 2*a* to 2*d*. The photosensitive material forming the photosensitive layers of the photosensitive member 2*a* to 2*d* may be amorphous silicon or organic material (organic photoconductor: OPC). The respective photosensitive members 2*a* to 2*d* are surrounded by developing devices 3*a* to 3*d*, optical exposures 4*a* to 4*d*, chargers 5*a* to 5*d*, and static eliminators 6*a* to 6*d*. The developing devices 3*a* to 3*d* correspond to black (B), yellow (Y), cyan (C), and magenta (M), and the same holds for the optical exposures 4*a* to 4*d*, the chargers 5*a* to 5*d*, and the static eliminators 6*a* to 6*d*. Each of the developing devices 3*a* to 3*d* is provided with a corresponding one of the toner-particle bearing members 400*a* to 400*d* and a vessel accommodating the toner particles 100, the carrier 300, and the magnetic roller all described above. The portion around each of the toner-particle bearing members 400*a* to 400*d* will be described later with reference to FIG. 6. The toner particles 100 contain a colorant of a corresponding color. An optical exposure unit 7 causes each of the optical exposures 4*a* to 4*d* to emit a laser beam to the surface of a corresponding one of the photosensitive members 2*a* to 2*d* based on image data input to an image input section (not illustrated) from a personal computer or the like.

In addition, the image forming apparatus 1 according to the present embodiment includes an intermediate transfer belt 8 that is tightly looped around a tension roller 9, a drive roller 10, and a driven roller 11. The photosensitive members 2*a* to 2*d* are disposed in contact with and thus confront the intermediate transfer belt 8 so as to be adjacent to one another from the upstream side in a conveyance direction of the intermediate transfer belt 8 (arrowed direction). In addition, primary transfer rollers 12*a* to 12*d* are disposed in contact with the intermediate transfer belt 8 respectively at the positions opposite the photosensitive members 2*a* to 2*d* across the intermediate transfer belt 8. In addition, a secondary transfer roller 13 is disposed in contact with the intermediate transfer belt 8 at the position opposite the drive roller 10 across the intermediate transfer belt 8. In addition, a cleaning roller 14 is disposed in contact with the intermediate transfer belt 8 at the position opposite the driven roller 11 across the intermediate transfer belt 8.

During image formation, the photosensitive members 2*a* to 2*d* rotate counterclockwise so that the chargers 5*a* to 5*d* uniformly charge the surfaces of the photosensitive members 2*a* to 2*d*. Subsequently, the optical exposures 4*a* to 4*d* irradiate the surfaces of the photosensitive members 2*a* to 2*d* with light based on image data. As a result, an electrostatic latent image is formed on the surface of each of the photosensitive members 2*a* to 2*d*. Next, by the action of a developing bias voltage applied to each of the toner-particle bearing members 400*a* to 400*d* in a corresponding one of the developing devices 3*a* to 3*d*, the toner particles of a corresponding color are attracted and adhered to the electrostatic latent image formed on a corresponding one of the photosensitive members 2*a* to 2*d*. As a result, a toner image is formed.

The toner images of the respective colors formed on the surfaces of the photosensitive members 2*a* to 2*d* are sequentially transferred to the intermediate transfer belt 8 running in the arrowed direction, by the primary transfer rollers 12*a* to 12*d* to which the primary transfer bias voltage (of opposite polarity to that of the toner particles) is applied. Through this primary transfer process, the toner images are layered on one another to form a full color toner image on the intermediate transfer belt 8.

A paper conveyance section 15 feeds paper P, which is a recording medium, stacked in a paper feed cassette 16 one sheet at a time. A pair of conveyance rollers 15*a* and 15*b* as well as a pair of registration rollers 15*c* and 15*d* convey the paper P to pass between the intermediate transfer belt 8 and the secondary transfer roller 13. Then, in the secondary transfer process, the full color toner image formed on the intermediate transfer belt 8 is transferred to the paper P by the secondary transfer roller 13 to which the secondary transfer bias voltage (of the opposite polarity to that of the toner particles) is applied.

The paper P having the full color toner image transferred thereto is conveyed to a fixing unit 17. Then, heat and pressure is applied by a fixing roller to fix the toner image on the surface of the paper P. As a result, a full color image is formed on the paper P. The fixing load applied for fixing may be 20 $N/cm^2$ or more and 100 $N/cm^2$ or less, for example. In addition, the fixing time may be 20 msec or more and 70 msec or less, for example. The paper P having the full color image formed thereon is further conveyed by a pair of ejection rollers 18*a* and 18*b* to be ejected out of the main body of the image forming apparatus 1.

Residual toner particles remaining on the photosensitive members 2*a* to 2*d* without being transferred to the intermediate transfer belt 8 in the primary transfer process are removed by respective cleaning devices. In addition, the residual charges on the surfaces of the respective photosensitive members 2*a* to 2*d* is eliminated by the static eliminators 6*a* to 6*d*. In addition, residual toner particles remaining on the intermediate transfer belt 8 without being transferred from the intermediate transfer belt 8 to the paper P in the secondary transfer process are removed by the cleaning roller 14 to which a cleaning bias voltage (opposite polarity to that of the toner particles) is applied. This places the intermediate transfer belt 8 in a state of readiness for the subsequent image formation.

Figure 6:
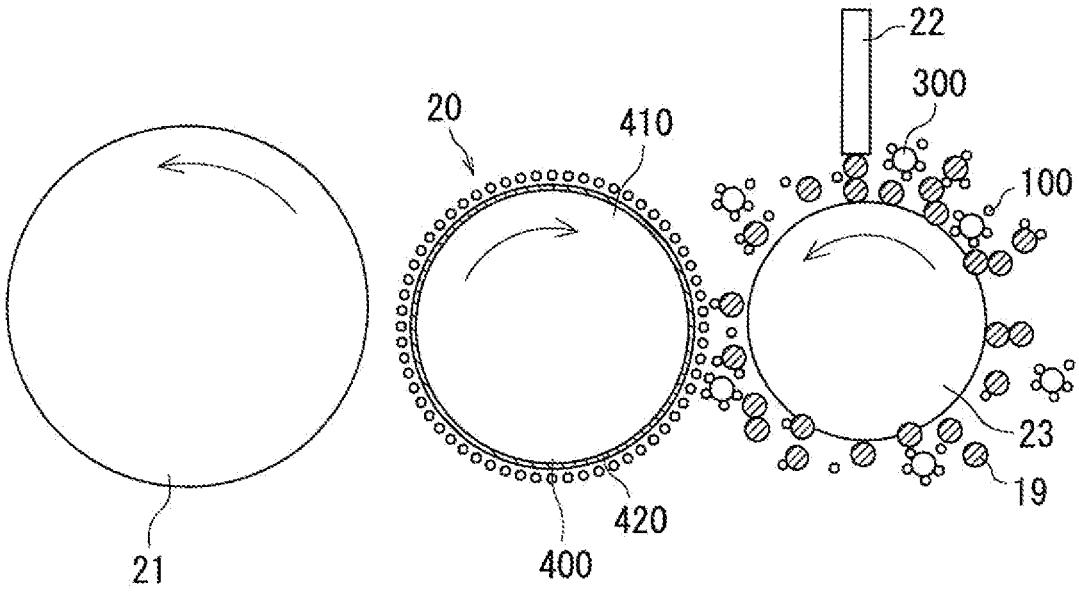
FIG. 6 is a schematic view showing a portion around the toner-particle bearing member of the image forming apparatus according to the present embodiment.

With reference to FIG. 6, the following describes the portion around the toner-particle bearing member 400, which collectively represents the toner-particle bearing members 400*a* to 400*d*, of the image forming apparatus 1 according to the present embodiment.

The image forming apparatus 1 includes the toner-particle bearing member 400 and uses the toner particle 100. The toner-particle bearing member 400 includes the substrate 410 and the surface layer 420 coating the surface of the substrate 410. A magnetic roller 23 is disposed adjacent to the toner-particle bearing member 400. The toner particles 100 and the carrier 300 together form a magnetic brush 19. By the action of the magnetic brush 19, the toner particles 100 are supplied to the toner-particle bearing member 400. Consequently, the toner-particle bearing member 400 bears the toner particles 100 in the form of a toner-particle layer 20.

The toner-particle bearing member 400 has the shape of a rotatable cylinder and may have a magnet disposed in its interior. The magnet causes a magnetic brush 19 of the carrier 300 to be formed. The layer thickness of the magnetic brush 19 is regulated by a regulating blade 22. Across the toner-particle bearing member 400 and the magnetic roller 23, a bias is applied by a power supply connected to the toner-particle bearing member 400 and also by a power supply connected to the magnetic roller 23. As a result, the toner particles 100 are pulled to the surface of toner-particle bearing member 400 to form the toner-particle layer 20. Then, from the toner-particle layer 20, the toner particles 100 are pulled to the photosensitive member 21 to develop an electrostatic latent image on the surface of the photosensitive member 21.

Even in the case where the toner particles 100 having a core-shell structure are used, the image forming method performed by using the image forming apparatus 1 ensures that the toner particles 100 are restricted from adhering to or being embedded in the toner-particle bearing member 400, in addition to that the toner particles 100 are restricted from being charged to an excessively high level.

EXAMPLES

The following describes the present disclosure by way of examples. It should be noted, however, that the present disclosure is in no way limited to the scope of the examples.

Example 1

(Preparation of Toner Cores)

First, a polyester resin was obtained in the following manner. That is, 1,245 g of terephthalic acid, 1,245 g of isophthalic acid, 1,248 g of bisphenol A-ethylene oxide adduct, and 744 g of ethylene glycol were put into a 5 L-four-necked flask. Then, a nitrogen atmosphere was maintained in the flask. While the contents of the flask were stirred, the internal temperature of the flask was raised up to 250° C. Then, the contents of the flask were left to react for four hours at 250° C. and atmospheric pressure. Then, 0.875 g of antimony trioxide, 0.548 g of triphenylphosphate, and 0.102 g of tetrabutyl titanate were added to the flask. Next, the internal pressure of the flask was reduced to 0.3 mmHg and the internal temperature of the flask was raised to 280° C. to leave the contents of the flask to react for 6 hours at 280° C. As a result, the polyester resin was obtained. Then, 30.0 g of trimellitic acid was added as a crosslinking agent to the flask and the internal pressure of the flask was returned to atmospheric pressure and the internal temperature of the flask was reduced to 270° C. The contents of the flask were then left to react for one hour at 270° C. and normal pressure. Once the reaction was complete, the contents of the flask were removed from the flask and cooled to obtain a polyester resin. The properties of the polyester resin were as follows: the number average molecular weight Mn of 2,400; the mass average molecular weight Mw of 6,500; the ratio Mw/Mn of the mass average molecular weight to the number average molecular weight of 2.7; the hydroxyl value of 20 mgKOH/g; the acid value of 40 mgKOH/g; the softening point Tm of 90° C.; the glass transition point Tg of 49° C.; and the SP value of 11.2.

Then, 100 parts by mass of the polyester resin, 5 parts by mass of the colorant (C.I. pigment blue 15:3 (copper phthalocyanine)), and 5 parts by mass of a releasing agent (ester wax, "WEP-3" manufactured by NOF Corporation) were mixed by a mixer (FM mixer). The resulting mixture was melt-kneaded by a two screw extruder (PCM-30 manufactured by Ikegai Corp). The resulting mixture was pulverized using a mechanical pulverizer ("Turbo Mill" manufactured by FREUND-TURBO CORPORATION), and the pulverized product was classified using a classifying apparatus ("Elbow-Jet" manufactured by Nittetsu Mining Co., Ltd.) to obtain toner cores having a volume average diameter of 6.0 μm, a number average diameter of 5.0 μm, and a circularity of 0.93.

The circularity was determined by calculating the average of circularities of 3,000 particles measured by using a flow particle imaging analyzer ("FPIA (registered trademark) 3000 manufactured by Sysmex Corporation).

The toner cores exhibited a triboelectric charge of −20 μC/g with a standard carrier ("N-01", standard carrier for use with negative-charging toners provided by the Imaging Society of Japan) and the zeta-potential in the pH 4 dispersion of −15 mV. In short, the toner cores were evidently anionic. In addition, the softening point Tm of the toner cores was 91° C. and the glass transition point Tg was 51° C.

(Shell Layer Formation)

The shell layers were formed on the surfaces of the toner cores in the following manner. That is, 300 mL of ion exchanged water was put into a 1 L-three-necked flask having a thermometer and a stirring blade, and the internal temperature of the flask was maintained at 30° C. by using a water bath. Subsequently, dilute hydrochloric acid was added to the flask to adjust the pH of the aqueous medium in the flask to 4. To the flask, 2 mL of an aqueous solution of methylol melamine ("Mirben resin SM-607" manufactured by Showa Denko K.K., solid content concentration of 80% by mass) was added as a material for the shell layers, in addition to a work function control agent. The contents of the flask were stirred to dissolve the raw materials of the shell layers in the aqueous medium. As a result, an aqueous solution (I) of the raw materials for the shell layers was obtained.

Next, 300 g of the toner cores were added to the aqueous solution (I) and the contents of the flask were stirred at 200 rpm for one hour. Subsequently, 300 mL of ion exchanged water was added to the flask. Thereafter, the internal temperature of the flask was raised to 70° C. at a rate of 1° C./minute while the contents of the flask were stirred at 100 rpm. After the temperature increase, the contents of the flask were stirred at 100 rpm for another 2 hours at 70° C. Then, the pH of the contents of the flask was adjusted to 7 through addition of sodium hydroxide. After the pH adjustment, the contents of the flask were cooled to room temperature to obtain a dispersion containing toner particles (toner mother particles) each having a shell layer formed to coat the surface of the toner core.

Then, the toner particles were washed in the following manner. A wet cake of the toner particles was obtained by filtration of the dispersion including the toner particles using a Büchner funnel. The toner particles were washed by redispersing the wet cake of the toner particles in ion exchanged water. Washing of the toner particles using ion exchanged water was repeated five times in the same manner. The filtrate of the dispersant containing the toner particles and water used for washing were collected as waste water. The conductivity of the toner particles after the filtration was 4 μS/cm.

Then, the toner particles thus collected were dried by being left to stand in a 40° C. atmosphere for 48 hours. As a result, the toner particles were obtained. The work function of the shell layers of the thus obtained toner particles was 3.34 eV.

(Preparation of Two-Component Developer)

First, an application liquid was prepared by dissolving 20 parts by mass of a silicone resin ("KR-271" manufactured by Shin-Etsu Chemical Co., Ltd.) in 200 parts by mass of toluene. By using a fluid bed coater, the thus prepared application liquid was sprayed to coat 1,000 parts by mass of carrier cores ("EF-35B" manufactured by Powdertech Co., Ltd). Subsequently, the resultant carrier cores were heated for 60 minutes at 200° C. to obtain a carrier. Finally, by using a ball mill, 100 parts by mass of the carrier was mixed with 10 parts by mass of the toner particles described above for 30 minutes to prepare a two-component developer.

(Forming of Toner-Particle Bearing Member)

First, an aqueous solution of the same materials as those of the aqueous solution (I) containing the row materials of the shell layers was prepared. The thus prepared aqueous solution was sprayed to the surface of a substrate, which in this case was a cylindrical tube made of aluminum (outer diameter ϕ: 20 mm). The spraying was carried out at a temperature of 25° C. and a humidity of 50% RH. Next, the resultant was heated for 60 minutes at 75° C. to harden the melamine resin into surface layer. As a result, a toner-particle bearing member was formed. The work function of the surface layer was 3.34 eV. The toner-particle bearing member thus formed was disposed in an image forming apparatus as shown in FIG. 5. In addition, the toner particles were supplied to the image forming apparatus to prepare an image forming apparatus of Example 1. The image forming apparatus was subjected to the evaluations (development stability and image density), which will be described later.

Example 2

An image forming apparatus of Example 2 was formed through the same procedures as Example 1, except that the additive amount of the work-function controlling agent was changed and the work function of the surface layer of the toner-particle bearing member was 3.52 eV. The image forming apparatus thus formed was subjected to the evaluations, which will be described later.

Example 3

An image forming apparatus of Example 3 was formed through the same procedures as Example 1, except that the additive amount of the work-function controlling agent was changed, the work function of the surface layer of the toner-particle bearing member was 3.66 eV, and the work function of the shell layers of the toner particles was 3.16 eV. The image forming apparatus thus formed was subjected to the evaluations, which will be described later.

Example 4

An image forming apparatus of Example 4 was formed through the same procedures as Example 1, except that the additive amount of the work-function controlling agent was changed, the work function of the surface layer of the toner-particle bearing member was 3.74 eV, and the work function of the shell layers of the toner particles were 3.14 eV. The image forming apparatus thus formed was subjected to the evaluations, which will be described later.

Example 5

An image forming apparatus of Example 5 was formed through the same procedures as Example 1, except that the additive amount of the work-function controlling agent was changed and the work function of the shell layers of the toner particles was 3.52 eV. The image forming apparatus thus formed was subjected to the evaluations, which will be described later.

Example 6

An image forming apparatus of Example 6 was formed through the same procedures as Example 1, except that the aqueous solution of methylol melamine ("Mirben resin SM-607" manufactured by Showa Denko K.K., solid concentration 80% by mass) used in Example 1 as a raw material of the surface layer was replaced by an aqueous solution of a phenolic resin ("PE-602 (trade name)" manufactured by DIC Corporation, solid concentration of 40% by mass). The work function of the surface layer was 0.24 eV. The work function of the shell layers was 0.19 eV. The image forming apparatus was subjected to the evaluations, which will be described later.

Comparative Example 1

An image forming apparatus of Comparative Example 1 was formed through the same procedures as Example 1, except that the toner particles used in Example 1 were replaced by the toner particles having no shell layers (i.e., by toner cores). The work function of the toner cores was 4.04 eV. The image forming apparatus thus formed was subjected to the evaluations, which will be described later.

Comparative Example 2

An image forming apparatus of Comparative Example 2 was formed through the same procedures as Example 1, except that the aqueous solution of methylol melamine ("Mirben resin SM-607" manufactured by Showa Denko K.K., solid concentration 80% by mass) used in Example 1 as a raw material of the surface layer was replaced by an aqueous solution of a urethane resin ("M-5350 (trade name)" manufactured by DIC Corporation, solid concentration of 50% by mass). The work function of the surface layer was 5.13 eV. The image forming apparatus thus formed was subjected to the evaluations, which will be described later.

Comparative Example 3

An image forming apparatus of Comparative Example 3 was formed through the same procedures as Comparative Example 2, except that the toner particles used in Comparative Example 2 were replaced by the toner particles having no shell layers (i.e., by toner cores). The work function of the toner cores was 4.04 eV. The image forming apparatus thus formed was subjected to the evaluations, which will be described later.

Comparative Example 4

An image forming apparatus of Comparative Example 4 was formed through the same procedures as Example 6, except that the toner particles used in Example 6 were replaced by the toner particles having no shell layers (i.e., by toner cores). The work function of the toner cores was 4.04 eV. The image forming apparatus thus formed was subjected to the evaluations, which will be described later.

Comparative Example 5

An image forming apparatus of Comparative Example 5 was formed through the same procedures as Comparative Example 2, expect that the aqueous solution of methylol melamine ("Mirben resin SM-607" manufactured by Showa Denko K.K., solid concentration 80% by mass) used in Comparative Example 2 as a raw material of the shell layers was replaced by an aqueous solution of a phenolic resin ("PE-602 (trade name)" manufactured by DIC Corporation, solid concentration of 40% by mass). The work function of the shell layers was 0.24 eV. The image forming apparatus thus formed was subjected to the evaluations, which will be described later.

The measurement and evaluation methods of the image forming apparatuses of Examples and Comparative Examples were as follows.

(1) Work Function

A photoemission spectroscopy ("AC-1" manufactured by Riken Keiki Co., Ltd.) was used to measure the work function of the shell layers of the toner particles and the work function of the surface layer of the toner-particle bearing member, on condition that the thickness of the shell layers and the thickness of the surface layer were all 10 nm. The measurement conditions are shown below.

Light source: Deuterium lamp

Scan energy range: 3.40 eV or more and 6.20 eV or less

Spectrometer: Grating monochromator (2) Charge Level of Toner-Particle Bearing Member Surface (Development Stability)

With respect to each of Examples and Comparative Examples, the two-component developer and the image forming apparatus were used to print a 5% coverage rate image on 100 sheets of paper. The charge level on the toner particles remaining on the toner-particle bearing member after the printing was measured. The charge level was measured by using a Q/M meter ("210HS-2A" manufactured by Trek Japan KK) on a sample obtained by sacking a layer formed of toner particles remaining on the toner-particle bearing member.

(3) Image Density (ID)

The electrostatic absorption of the toner particles to the surface of the toner-particle bearing member was evaluated by measuring the image density (ID). With respect to each of Examples and Comparative Examples, the two-component developer and the image forming apparatus were used to print a 5% coverage rate image on 100 sheets of paper. Subsequently, the image forming apparatus was caused to output a sample image containing a solid-image area and the ID of the solid image portion was measured by using a 1 Macbeth reflection densitometer ("SPM-50" manufactured by Sakata Inx Eng. Co., Ltd.). The image density of 1.30 or more is determined acceptable. The progress of electrostatic adsorption of the toner particles to the surface of the toner-particle bearing member reduces the developability and thus reduces the ID value of the resulting image.

Table 1 shows all the evaluation results of Examples and Comparative Examples.

TABLE 1

| | Toner-Particle Bearing Member | | Toner particle | | Difference in Work Function between | Evaluations: Charge Level of Toner Particles on | |
|---|---|---|---|---|---|---|---|
| | Type of Thermosetting Resin Forming Surface Layer | Work Function eV | Type of Thermosetting Resin Forming Shell Layers | Work Function eV | Toner-Particle Bearing Member and Toner Particles eV | Surface of Toner-Particle Bearing Member μC/g | ID value |
| Example 1 | Melamine Resin | 3.34 | Melamine Resin | 3.34 | 0.00 | 13.24 | 1.40 |
| Example 2 | Melamine Resin | 3.52 | Melamine Resin | 3.34 | 0.19 | 12.49 | 1.38 |
| Example 3 | Melamine Resin | 3.66 | Melamine Resin | 3.16 | 0.50 | 13.78 | 1.35 |
| Example 4 | Melamine Resin | 3.74 | Melamine Resin | 3.14 | 0.60 | 15.89 | 1.32 |
| Example 5 | Melamine Resin | 3.34 | Melamine Resin | 3.52 | 0.18 | 16.19 | 1.33 |
| Example 6 | Phenolic Resin | 0.19 | Phenolic Resin | 0.24 | 0.05 | 8.57 | 0.56 |
| Comparative Example 1 | Melamine Resin | 3.34 | — | 4.04 | 0.70 | 21.12 | 1.21 |
| Comparative Example 2 | Urethane Resin | 5.13 | Melamine Resin | 3.34 | 1.79 | 29.76 | 1.06 |
| Comparative Example 3 | Urethane Resin | 5.13 | — | 4.04 | 1.09 | 24.59 | 1.12 |
| Comparative Example 4 | Phenolic Resin | 0.19 | — | 4.04 | 2.90 | 35.72 | 0.47 |
| Comparative Example 5 | Urethane Resin | 5.13 | Phenolic Resin | 0.24 | 4.89 | 45.97 | 0.32 |

In Table 1, the representation "-" indicates that the toner particles have no shell layers.

Each of Examples 1 to 6 used an image forming apparatus including a toner-particle bearing member having a substrate and a surface layer coating the surface of the substrate. In addition, the developer containing the toner particles having a core-shell structure was used to form images. The surface layer and the shell layers were all formed from a resin containing a thermosetting resin. Consequently, as is clear from Table 1, Examples 1 to 6 all evaluated as having excellent development stability. In addition, adhesion of the toner particles to the toner-particle bearing member was duly restricted and the images were formed to have a desired level of density.

In each of Comparative Examples 1 and 4, images were formed by using a two-component developer containing toner particles having toner cores not coated with shell layers. Consequently, the development stability was inferior, and the resulting images were evaluated defective because the image density was less than a desired level due to adhesion of toner particles to the toner-particle bearing member.

Each of Comparative Examples 2 and 5 used a toner-particle bearing member having a surface layer formed from a urethane resin instead of a thermosetting resin. Consequently, the development stability was inferior and the resulting images were evaluated defective because the image density was less than a desired level due to adhesion of toner particles to the toner-particle bearing member.

Comparative Example 3 used a toner-particle bearing member having a surface layer formed from a urethane resin instead of a thermosetting resin. In addition, a two-component developer used for image formation contained toner particles having toner cores not coated with shell layers. Consequently, the development stability was inferior and the resulting images were evaluated defective because the image density was less than a desired level due to adhesion of toner particles to the toner-particle bearing member.

What is claimed is:

1. An image forming apparatus that uses a developer containing toner particles, the image forming apparatus comprising:

a developing device, wherein the developing device includes a vessel configured to accommodate the toner particles and a development roller configured to bear the toner particles, each toner particle includes a toner core containing a binder resin and a shell layer coating a surface of the toner core, the development roller includes a substrate and a surface layer coating a surface of the substrate, and the surface layer of the development roller and the shell layers of the toner particles are each formed from a resin containing a thermosetting resin, and a work function of the surface layer and a work function of the shell layers are 3.0 eV or more.

2. An image forming apparatus according to claim 1, wherein a difference between a work function of the surface layer and a work function of the shell layers is 0.5 eV or less.

3. An image forming apparatus according to claim 1, wherein the surface layer and the shell layers are formed from the same thermosetting resin.

4. An image forming apparatus according to claim 3, wherein the thermosetting resin is a melamine resin.

5. An image forming apparatus that uses a developer containing toner particles, the image forming apparatus comprising:

a developing device, wherein the developing device includes a vessel configured to accommodate the toner particles and a development roller configured to bear the toner particles, each toner particle includes a toner core containing a binder resin and a shell layer coating a surface of the toner core, the development roller includes a substrate and a surface layer coating a surface of the substrate, the surface layer of the development roller and the shell layers of the toner particles are each formed from a resin containing a thermosetting resin, and the surface layer and the shell layers each have a thickness of 5 nm or more and 100 nm or less.

6. An image forming apparatus according to claim 1, wherein touchdown developing is employed.

7. An image forming method comprising:

forming, by an image forming apparatus, an image with use of a developer, wherein the developer includes toner particles each including a toner core containing a binder resin, and a shell layer coating a surface of the toner core, the image forming apparatus includes a developing device including a vessel configured to accommodate the toner particles and a development roller configured to bear the toner particles, the development roller includes a substrate, and a surface layer coating a surface of the substrate, the surface layer of the development roller and the shell layers of the toner particles are each formed from a resin containing a thermosetting resin, and the surface layer and the shell layers each have a thickness of 5 nm or more and 100 nm or less.

8. An image forming apparatus according to claim 1, wherein the substrate of the development roller is formed from a non-magnetic metal or an alloy of a non-magnetic metal.

9. An image forming apparatus according to claim 1, further comprising:

a photosensitive member;

a charger configured to charge a surface of the photosensitive member; and an optical exposure configured to irradiate the charged surface of the photosensitive member with light to form an electrostatic latent image on the surface of the photosensitive member, wherein the development roller is configured to, upon a voltage being applied thereto, cause the toner particles borne thereby to adhere to the electrostatic latent image to form a toner image on the surface of the photosensitive member.

10. An image forming apparatus according to claim 1, wherein the binder resin is a thermoplastic resin.

* * * * *